US005533451A

United States Patent [19]

Matsuo et al.

[11] Patent Number: 5,533,451

[45] Date of Patent: Jul. 9, 1996

[54] IMAGE TRANSFER APPARATUS WITH TRANSFER DRUM CLAMPING MECHANISM

[75] Inventors: Masaaki Matsuo; Takayuki Kimura, both of Tokyo, Japan

[73] Assignee: Toyo Ink Manufacturing Co., Ltd., Tokyo, Japan

[21] Appl. No.: 157,202

[22] PCT Filed: Apr. 13, 1993

[86] PCT No.: PCT/JP93/00477

§ 371 Date: Oct. 27, 1919

§ 102(e) Date: Oct. 27, 1994

[87] PCT Pub. No.: WO93/21017

PCT Pub. Date: Oct. 28, 1993

[30] Foreign Application Priority Data

Apr. 13, 1992 [JP] Japan ..... 4-119674
Apr. 13, 1992 [JP] Japan ..... 4-119676

[51] Int. Cl.[6] ..... B41F 1/28

[52] U.S. Cl. ..... 101/415.1; 101/232; 271/82; 271/277; 355/317

[58] Field of Search ..... 101/415.1, 409, 101/410, 411, 232, 378; 271/277, 82; 355/317

[56] References Cited

U.S. PATENT DOCUMENTS

| | | | |
|---|---|---|---|
| 3,768,406 | 10/1973 | Gutsche et al. | 101/409 |
| 4,120,492 | 10/1978 | Černý | 101/411 |
| 4,326,792 | 4/1982 | Landa | 271/277 |
| 4,503,772 | 3/1985 | Urakawa et al. | 101/409 |
| 4,891,655 | 1/1990 | Watanabe | 346/151 |
| 5,076,167 | 12/1991 | Herold et al. | 101/415.1 |
| 5,199,352 | 4/1993 | Sugiyama . | |
| 5,253,583 | 10/1993 | Yamamoto et al. | 101/415.1 |

FOREIGN PATENT DOCUMENTS

| | | | |
|---|---|---|---|
| 0195848 | 10/1986 | European Pat. Off. | 101/415.1 |
| 0272802 | 6/1988 | European Pat. Off. . | |
| 0350195 | 1/1990 | European Pat. Off. . | |
| 0519656 | 12/1992 | European Pat. Off. . | |
| 3445886 | 6/1986 | Germany | 101/411 |
| 55-159658 | 11/1980 | Japan . | |
| 63-249676 | 10/1988 | Japan . | |
| 1-83563 | 6/1989 | Japan . | |

OTHER PUBLICATIONS

"Mechanism and Actuator for Clamping Sheets on Drum" IBM Technical Disclosure Bulletin, vol. 23 No. 7A, Dec. 1980 pp. 2679–2682.

*Primary Examiner*—Eugene H. Eickholt
*Attorney, Agent, or Firm*—Wenderoth, Lind & Ponack

[57] ABSTRACT

An image transfer apparatus comprises a platen (8) to which an image-forming material is to be attached and a transfer cylinder (1) to which an image receptor is to be attached. An image formed in a photosensitive layer of the image-forming material is transferred to image receptor by the introduction of the image-forming material and the image receptor into a nip formed by the platen and the transfer cylinder by the rotation of the platen and the transfer cylinder. The image transfer apparatus has an image receptor attaching device that includes holders (3,5) and holder seats (4,6) for holding the entire length of a top end side of the image receptor to a surface of the transfer cylinder and the entire length of a bottom end side of the image receptor to a surface of the transfer cylinder. The image receptor attaching device for holding the top end side of the image receptor has the holders (3) and holder seats (4) provided along an axial-length direction of the transfer cylinder in a cut-off portion (2) provided in part of the surface of the transfer cylinder. There are at least two holders 3 separated along the axial direction and at least two seat holders separated along the axial direction, and a gap provided in each interval between the holder seats.

14 Claims, 2 Drawing Sheets

IMAGE TRANSFER APPARATUS WITH TRANSFER DRUM CLAMPING MECHANISM

TECHNICAL FIELD

The present invention relates to an image transfer apparatus for transferring an image formed in a photosensitive layer of an image-forming material to an image receptor. The apparatus has an image receptor attaching device capable of holding the image receptor with uniform pressure. Further, the present invention relates to an image transfer apparatus having an image receptor attaching device for facilely and quickly attaching an image receptor while a transfer cylinder is under heat without causing nonuniformity of the length of the image receptor which is inserted into an image receptor clamp or nonuniformity of clamp holding power when the image receptor is attached due to the undulation and curling of the image receptor.

TECHNICAL BACKGROUND

A single-color or multi-color prepress proof suitable for proof printing, etc., has been increasingly produced recently. The prepress proof is produced by imagewise exposing an image-forming material comprising a substrate and a photosensitive layer formed on one surface of the substrate and then transferring an image to an image receptor such as paper under heat, generally around 100° C. The image-forming material is formed of a substrate, a photosensitive layer formed on one surface of the substrate and a protection layer. As the substrate and the protection layer, a thin film or sheet formed from a material such as cellulose acetate, polystyrene, polyvinyl chloride or polyethylene terephthalate is used. As the image receptor, a properly selected printing sheet such as paper or a film is used.

As an apparatus for preparing the above prepress proof, generally, there has been proposed an image-transfer apparatus having a platen to which an image-forming material is to be attached and a transfer cylinder to which an image receptor is to be attached. The platen and the transfer cylinder are brought into contact so that a photosensitive layer of the image-forming material and an image receptor are brought into contact with each other under pressure to transfer an image formed on the photosensitive layer to the image receptor in a nip portion formed by the platen and the transfer cylinder. The image receptor, such as paper, is preliminarily heated, and the image formed on the photosensitive layer of the above image-forming material is transferred to the paper by bringing the photosensitive layer into contact therewith under pressure, whereby the transfer of the image smoothly proceeds to give an aesthetically fine printed sheet. Generally, therefore, a means for heating the surface of the transfer cylinder at a proper temperature, e.g., around 100° C., is provided within the transfer cylinder to which the image receptor is to be attached.

As a device for attaching the image receptor, there has been used a device comprising a clamp consisting of one set of a holder and a holder seat, which clamp extends in the length direction of the transfer cylinder axis and is provided in the partial cut-off portion of the transfer cylinder, and the image receptor is held by means of the clamp. This clamp is usually made of a metal in order to utilize sufficient pressure between the holder and the holder seat. Therefore, the heat of the heated transfer cylinder is transmitted to the clamp, and the holder and the holder seat curve in operation. It has therefore been difficult in many cases to hold the image receptor under uniform pressure. The image receptor itself is mostly of paper, etc., which undergoes curling due to heat. Therefore, in inserting the image receptor into a narrow gap between the holder and the holder seat, the curving of the holder and the holder seat causes defective fixing of the image receptor. E.g., folding of the paper occurs within the clamp in some cases. Because of this, a wrinkle occurs near the holding portion, or the inserted portion of the image receptor within the holder is not uniform in length. Further, a wrinkle occurs in the edge of a produced print, or the holding pressure of the holder is non-uniform.

Conventionally, it has been strongly desired to develop a device for holding the image receptor that attaches the image receptor onto the transfer cylinder and with which a soft sheet-like substance such as an image receptor can be easily attached and detached and the image receptor can be held without causing defects by attaching. No device which satisfies this desire has been developed.

SUMMARY OF THE INVENTION

It is therefore an object of the present invention to provide an image transfer apparatus such as an apparatus for producing a prepress proof. The image transfer apparatus has an image receptor attaching device with which a soft sheet-like substance, such as the image receptor, can be easily attached and detached and held under uniform pressure in operation. It is a further object of the present invention to provide an image transfer apparatus having an image receptor attaching device with which a soft sheet-like substance, such as the image receptor, can be promptly inserted into a holder such that the length of the inserted portion is constant and the sheet-like substance can be easily attached and detached.

The present invention thus provides an image transfer apparatus which comprises a platen to which an image-forming material is to be attached and a transfer cylinder to which an image receptor is to be attached. An image formed in a photosensitive layer of an image-forming material is transferred to an image receptor by the introduction of the image-forming material and the image receptor into a nip formed by the platen and the transfer cylinder by the rotation of the platen and the transfer cylinder.

The image transfer apparatus has an image receptor attaching device comprising holders and holder seats for holding the entire length of a top end side of the image receptor to a surface of the transfer cylinder and an image receptor attaching device comprising holders and holder seats for holding the entire length of a bottom end side of the image receptor to the surface of the transfer cylinder. The image receptor attaching device for holding the top end side of the image receptor comprises holders and holder seats provided along an axial-length direction of the transfer cylinder in a cut-off portion provided in part of the surface of the transfer cylinder. The holders comprise at least two holders separated along the axial direction. The holder seats comprise at least two seat holders separated along the axial direction with a gap provided in each interval between the holder seats.

Further, the present invention provides an image transfer apparatus according to the above description in which a stopper for positioning the image receptor is provided between the holders separated along the axial-length direction of thee transfer cylinder.

DETAILED DESCRIPTION OF A PREFERRED EMBODIMENT OF THE INVENTION

Figure 1:
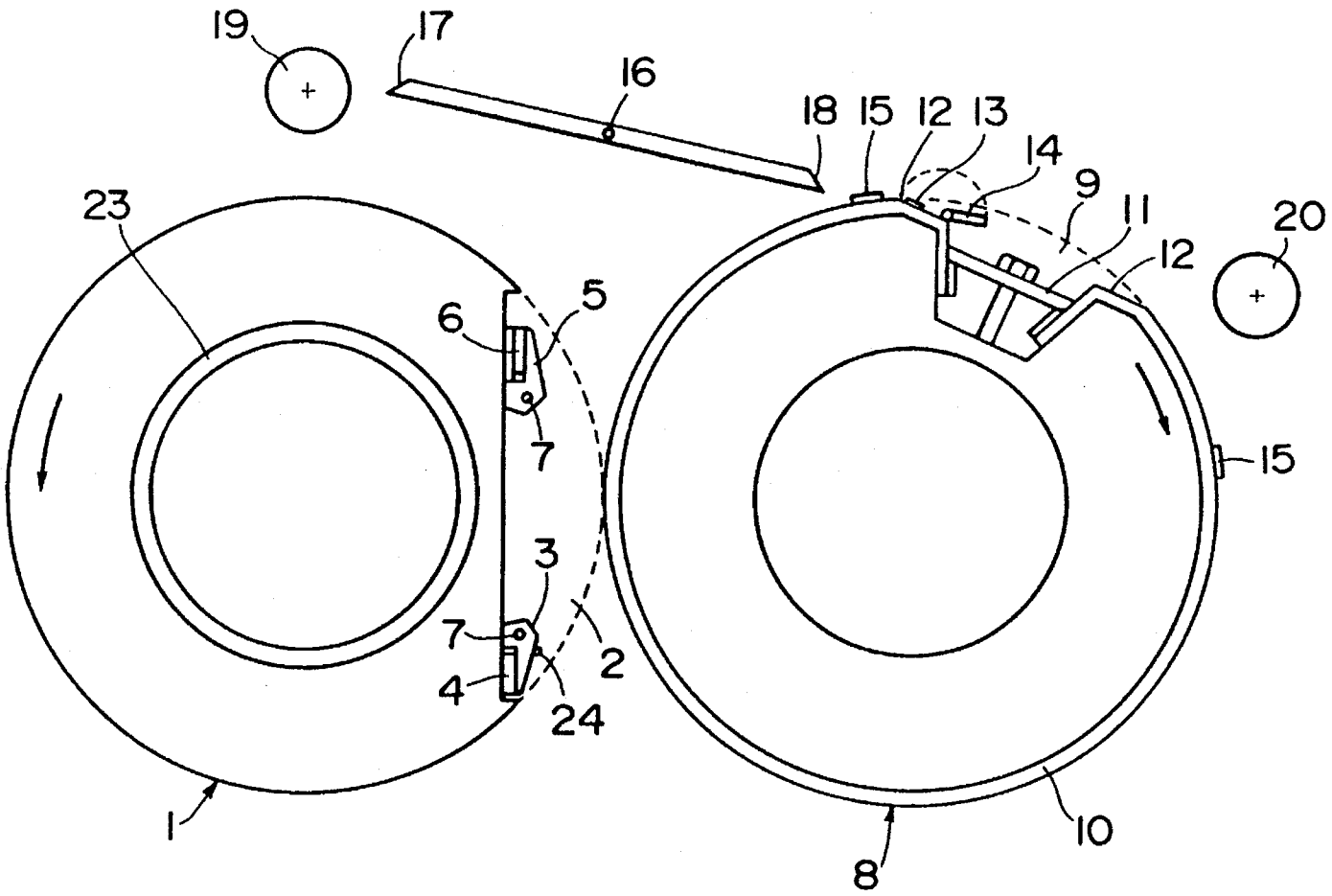
FIG. 1 shows a schematic cross section of an image transfer apparatus of the present invention that has a platen which includes an image attaching apparatus and to which an image-forming material .is to be attached and a transfer cylinder to which an image receptor such as paper is to be attached.

The present invention will be detailed hereinafter with reference to attached drawings. FIG. 1 shows the constitution of an image transfer apparatus used in the present invention.

A surface of a transfer cylinder 1 is provided with a partial cut-off portion 2. A means for attaching a top end side (leading end side) of an image receptor, comprising a holder 3 and a holder seat 4, and a means for attaching a bottom end side (trailing end side) of the image receptor, comprising a holder 5 and a holder seat 6, are provided within the above partial cut-off portion. The holders 3 and 5 are provided with actuation shafts 7 on which the holders are actuated by a manual or electric actuator or actuation means. The holders are allowed to open and close by the rotation of the actuation means.

One embodiment of tile constitution of a platen 8 will be explained with reference to FIG. 1. The platen 8 is provided with a partial cut-off portion 9. The surface of the platen 8 is wrapped with a blanket 10, and the blanket 10 is fixed within the partial cut-off portion with a blanket fixing device 11. The partial cut-off portion 9 has slope portions 12 extending between the partial cut-off portion and a platen surface (circumferential surface). One slope portion 12 is provided with a pin bar 13. The pin bar 13 has such a height that its top does not protrude over the circumferential surface of the platen 8. Accordingly, neither the pin bar 13 nor the surface of the transfer cylinder 1 are damaged in the rotation of tile platen 8 and the transfer cylinder 1. A magnet sheet 14 may be tiltably attached within the partial cut-off portion 9 for further securing the holding of an image-forming material to the platen surface. An adhesive tape 15 is provided on a platen surface near the slope portion 12 where the pin bar 13 is located, and another adhesive tape 15 is also provided on a platen surface near the other slope portion 12. The magnet sheet 14 is not so wide as to reach the former adhesive tape 15, but is so wide as to cover the pin bar 13 when the magnet sheet is tilted in the direction opposite to the arrow indicated on the platen 8. The top end side of an image-forming material has holes corresponding to pins of the pin bar 13. These holes are fit to the pins of the pin bar 13, and the image-forming material is pressed with the magnet sheet 14, Then, the platen 8 is turned in the direction of the arrow, and the top end side and bottom end side of the image-forming material are fixed to the surface of tile platen with the adhesive tapes 15.

Above the transfer cylinder 1 and the platen 8, preferably, there is provided a tray which can tilt with a fulcrum 16 as a center so that its end portions 17 and 18 can come close to the transfer cylinder and the platen surface, respectively. An image-forming material or an image receptor is placed on the tray for facilitating the fixing or removal of the image-forming material or the image receptor. A drawing roller 19 may be provided such that it can be in contact with the surface of the transfer cylinder 1 as required, and a drawing roller 20 may be provided such that it can be in contact with the surface of the platen 8 as required. The drawing roller 19 is effective for bringing the image receptor into close contact with the transfer cylinder surface and removing the wrinkle and slackening of the image receptor when the image receptor is attached to the transfer cylinder surface. The drawing roller 20 is similarly effective when the image-forming material is attached to the platen surface.

Figure 2:
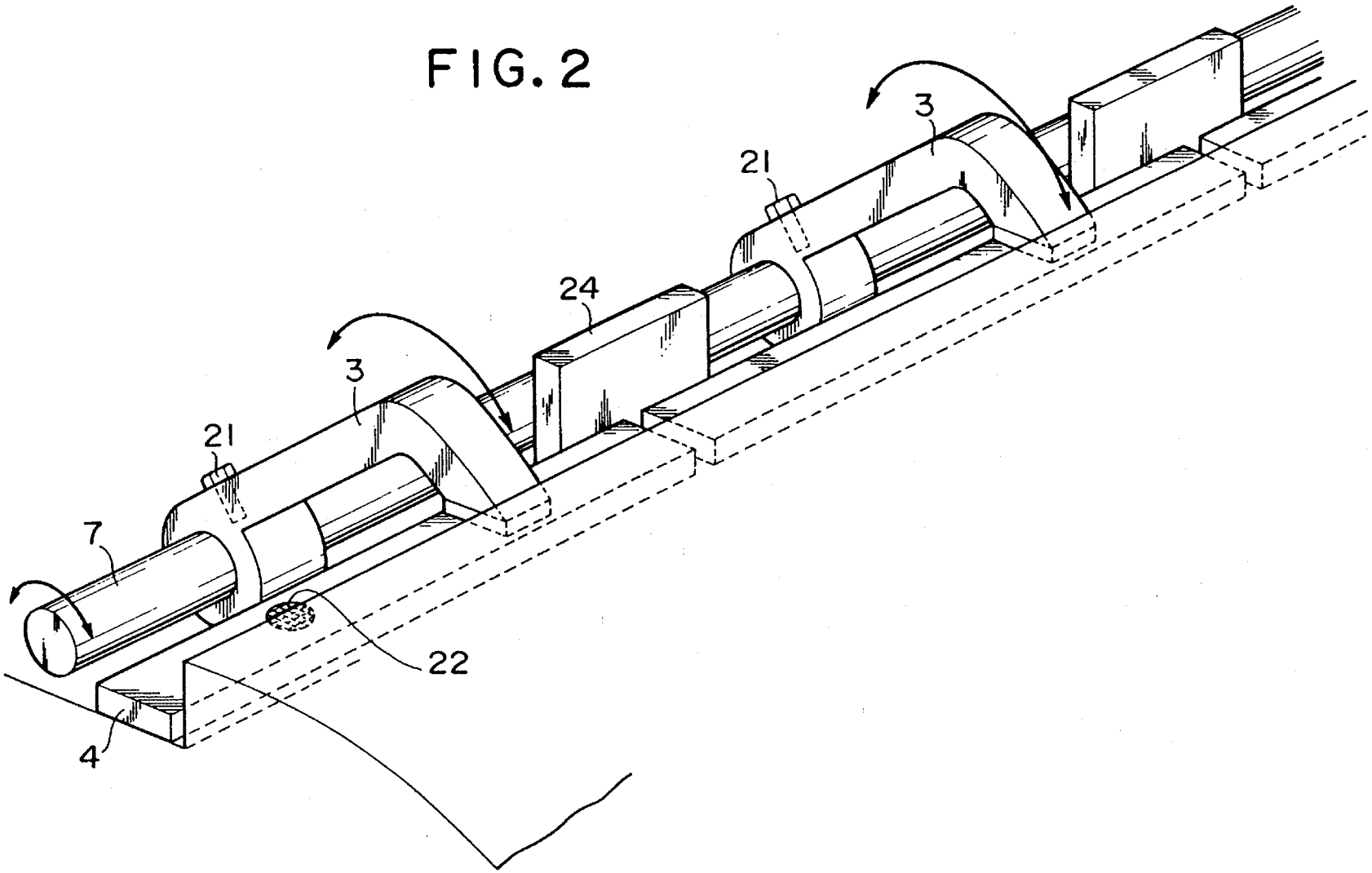
FIG. 2 is a partially enlarged view of a device for attaching a top end side of the image receptor.

FIG. 2 is a partially enlarged view of an image receptor attaching device for attaching the top end (leading end) side of an image receptor, which device comprises the holders 3 and holder seats 4. A plurality of the holder seats 4 are separated in the axial-length direction of the transfer cylinder 1, and a gap is provided in each interval between the holder seats. These gaps prevent the holder seats from being curved by their thermal expansion or shrinkage. Further, a plurality of the holders 3 are separated in the axial-direction of the transfer cylinder 1, and a gap is provided in each interval between the holders 3. These gaps prevent the holders from being curved by their thermal expansion or shrinkage. The holders 3 are simultaneously actuated by an actuation shaft 7 communicating and connecting all the holders 3. Preferably, each of the holders 3 is provided with a bolt 21 for adjusting a holder attachment angle, and each bolt 21 is provided near the actuation shaft 7 for the holders 3. Each bolt is for adjusting the attachment angle of its corresponding holder 3 to the actuation shaft 7, and the image receptor holding pressure of each holder 3 is thus independently adjusted. The image receptor attaching device comprising holders 5 and holder seats 6 for attaching the bottom end (trailing end) side of the image receptor may have a structure similar to that of the image receptor attaching device for attaching the top end side of the image receptor. Further, an image receptor sensor 22 for sensing the portion of the image receptor which is inserted into the clamp, and preferably a plurality of such image receptor sensors 22, may be provided in the holder seat (s) 4.

It is preferred to provide a stopper 24 for positioning the image receptor in each interval between the holders separated in the axial-length direction of the transfer cylinder. Further, the surface of each holder 3 which is to come into contact with the image receptor, and/or which is to come into contact with the image receptor and/or the surface of each holder seat 4 which is to come into contact with the image receptor, may be formed of an elastic resin for securing the holding of the image receptor.

The function of the image transfer apparatus having the above image receptor attaching devices, provided by the present invention, will be explained hereinafter.

The top end portion of an image receptor (not shown) is held by the clamp comprising the holders 3 and the holder seats 4 provided in the partial cut-off portion 2 of the transfer cylinder 1. Then, the transfer cylinder 1 is rotated in the arrow direction shown in FIG. 1, and the bottom end portion of the image receptor is held by the clamp comprising the holders 5 and the seats 6, whereby the image receptor is attached to the transfer cylinder 1. The holders 3 and the holders 5 are actuated with the actuation shafts 7. A heater or heating means 23 for heating the transfer cylinder surface to about 100° C. for keeping the image receptor warm in advance of the image transfer operation is provided within the transfer cylinder 1. For this reason, the heat-induced curving of the holders and holder seats and the curling and wrinkling of the image receptor when inserting tile image receptor are liable to occur. As a result, the holding pressure of the clamps is liable to be nonuniform, and the attachment of the image receptor is liable to be defective, For overcoming the above problems, the present invention uses a plurality of the holder seats 4 which are separated by intervals in the axial-length direction of the transfer cylinder 1 as shown in FIG. 2. Further, the present invention uses a plurality of the holders 3 which are separated by intervals in the axial-length direction of the transfer cylinder 1. As a result, the curving of the holders and holder seats can be prevented, and the image receptor is constantly held under uniform pressure. Further, defective attachment of the image receptor caused by the holder and holder seats can be prevented. The holders 5 and holder seats 6 may have the same structures as those of the holders 3 and holder seats 4. A plurality of the holders 3, separated in the axial direction of the transfer cylinder 1, are simultaneously actuated by the actuation shaft 7 communicating with and connecting each holder 3. As a result, the separated holders can be simultaneously actuated, and the operation for attaching the image receptor is hence facile.

The stopper 24 for positioning the image receptor is provided in each interval between the holders 3, separated in the axial-length direction, whereby the portion of the image receptor which is to be held by the holders 3 and holder seats 4 can be promptly made constant when the image receptor is inserted into the gaps between the holders 3 and the holder seats 4. It is not necessary to provide the image receptor attaching device for attaching the bottom end side of the image receptor with such a stopper for positioning the image receptor, since the image receptor is held under tension.

After the top end side of the image receptor is held by the clamp, preferably, the transfer cylinder 1 is rotated in the arrow direction, keeping the image receptor in close contact with the transfer cylinder surface with the drawing roller 19, and then the image receptor is held by the clamp for the bottom end side. The holder seats 6 may be provided with a sensor for sensing the image receptor.

The image transfer is carried out by introducing the image receptor attached to the transfer cylinder 1 and the image-forming material attached to the platen 8 into a nip formed by the transfer cylinder 1 and the platen 8 to transfer an image formed on the photosensitive layer of the image-forming material to the image receptor under pressure.

According to the present invention, the image receptor can be easily attached and detached, and the curving of the clamp under heat can be prevented. Therefore, there is provided an image transfer apparatus having an image receptor attaching device with which the power of the holders and holder seats for holding the image receptor can be made uniform and the image receptor is firmly held. Further, according to the present invention, there is provided an image transfer apparatus having an image receptor attaching device with which the image receptor can be attached to the transfer cylinder such that that the length of the image receptor which is to be held is constant. As a result, variability of the holding pressure of the clamp in the axial-length direction of the transfer cylinder, and trouble when inserting the image receptor into the clamp such as wrinkles, etc., can be prevented.

We claim:

1. An image transfer apparatus, comprising:

a platen;

a transfer cylinder located relative to said platen such that said platen and said transfer cylinder form a nip therebetween, whereby an image can be transferred from a photosensitive layer of an image-forming material on said platen to an image receptor on said transfer cylinder by introducing the image-forming material and the image receptor into said nip between said platen and said transfer cylinder by rotation of said platen and said transfer cylinder, said transfer cylinder having an outer surface and an axis having an axial direction;

a cut-off portion provided in said outer surface of said transfer cylinder;

a first image receptor attaching device comprising first holders and first holder seats for holding the entire length of a top end of the image receptor to said outer surface of said transfer cylinder, said first holders comprising at least two first holders provided along and separated from each other in said axial direction, and said first holder seats comprising at least two first holder seats provided along and separated from each other in said axial direction, wherein said first holder seats are separated from each other by gaps provided therebetween, and wherein said first holders and said first holder seats are disposed in said cut-off portion; and a second image receptor attaching device comprising second holders and second holder seats for holding the entire length of a bottom end of the image receptor to said outer surface of said transfer cylinder;

wherein each of said first holders are communicated with a first common actuation shaft for simultaneous actuation.

2. The image transfer apparatus of claim 1, wherein each of said second holders are communicated with a second common actuation shaft for simultaneous actuation.

3. The image transfer apparatus of claim 2, wherein each of said second holders are connected to said second common actuation shaft.

4. The image transfer apparatus of claim 1, wherein each of said first holders are connected to said first common actuation shaft.

5. The image transfer apparatus of claim 1, wherein said first image receptor attaching device further comprises at least one interval between said at least two first holders separated from each other in said axial direction and at least one stopper disposed between said at least two first holders for positioning the image receptor in respective ones of said at least one interval between said at least two first holders.

6. The image transfer apparatus of claim 5, wherein each said at least one stopper is positioned adjacent to each of said gaps between said first holder seats and fixed relative to said transfer cylinder, said stoppers extending radially outwardly relative to said transfer cylinder to a position further radially outward than said first holder seats.

7. The image transfer apparatus of claim 1, wherein said second holders comprise at least two second holders provided along and separated from each other in said axial direction, and said second holder seats comprise at least two second holder seats provided along and separated from each other in said axial direction, wherein said second holder seats are separated from each other by gaps provided therebetween, and wherein said second holders and said second holder seats are disposed in said cutoff portion.

8. An image transfer apparatus, comprising:

a rotatable platen;

a rotatable transfer cylinder located relative to said platen such that said platen and said transfer cylinder form a nip therebetween, said transfer cylinder having an outer surface and an axis having an axial direction;

a cut-off portion provided in said outer surface of said transfer cylinder;

a first image receptor attaching device comprising first holders and first holder seats, said first holders comprising at least two first holders provided along and separated from each other in said axial direction, and said first holder seats comprising at least two first holder seats provided along and separated from each other in said axial direction, wherein said first holder seats are separated from each other by gaps provided therebetween, and wherein said first holders and said first holder seats are disposed in said cutoff portion; and a second image receptor attaching device comprising second holders and second holder seats;

wherein each of said first holders are communicated with a first common actuation shaft.

9. The image transfer apparatus of claim 8, wherein each of said second holders are communicated with a second common actuation shaft.

10. The image transfer apparatus of claim 8, wherein each of said first holders are connected to said first common actuation shaft.

11. The image transfer apparatus of claim 8, wherein said first image receptor attaching device further comprises at least one interval between said at least two first holders separated from each other in said axial direction and at least one image receptor stopper disposed between said at least two first holders.

12. The image transfer apparatus of claim 11, wherein each said at least one stopper is positioned adjacent to each of said gaps between said first holder seats, said stoppers extending radially outwardly relative to said transfer cylinder to a position further radially outward than said first holder seats.

13. The image transfer apparatus of claim 8, wherein said second holders comprise at least two second holders provided along and separated from each other in said axial direction, and said second holder seats comprise at least two second holder seats provided along and separated from each other in said axial direction, wherein said second holder seats are separated from each other by gaps provided therebetween, and wherein said second holders and said second holder seats are disposed in said cutoff portion.

14. The image transfer apparatus of claim 8, and further comprising a heater in said transfer cylinder.

* * * * *